US007587820B2

(12) United States Patent
Ooyauchi et al.

(10) Patent No.: US 7,587,820 B2
(45) Date of Patent: Sep. 15, 2009

(54) METAL TUBULAR BODY AND MANUFACTURING METHOD THEREOF

(75) Inventors: Tetsuya Ooyauchi, Kanagawa (JP); Masayuki Okano, Tokyo (JP)

(73) Assignees: Terumo Kabushiki Kaisha, Shibuya-Ku, Tokyo (JP); Okano Kogyo Co., Ltd., Sumida-Ku, Tokyo (JP)

( * ) Notice: Subject to any disclaimer, the term of this patent is extended or adjusted under 35 U.S.C. 154(b) by 674 days.

(21) Appl. No.: 11/062,547

(22) Filed: Feb. 23, 2005

(65) Prior Publication Data

US 2005/0145676 A1 Jul. 7, 2005

Related U.S. Application Data

(62) Division of application No. 10/329,513, filed on Dec. 27, 2002, now Pat. No. 6,877,652.

(30) Foreign Application Priority Data

Dec. 27, 2001 (JP) ..... 2001-397369

(51) Int. Cl.
*B21D 39/06* (2006.01)

(52) U.S. Cl. ..... 29/890.038

(58) Field of Classification Search ..... 29/423, 29/890.038, 890.03, 890.043; 228/101, 170, 228/173.6; 72/330, 370.27, 329
See application file for complete search history.

(56) References Cited

U.S. PATENT DOCUMENTS 3,651,807 A 3/1972 Huggins
3,793,971 A 2/1974 Mueller
4,148,426 A 4/1979 Midzutani et al.
4,628,720 A 12/1986 Tani et al.
4,735,575 A 4/1988 Shaffer
4,785,868 A 11/1988 Koenig, Jr.

(Continued)

FOREIGN PATENT DOCUMENTS

EP 0 180 125 A2 5/1986

(Continued)

OTHER PUBLICATIONS

Japanese Office Action for Japanese Patent Application No. 2001-397369, dated Jul. 10, 2007 and partial English translation thereof.

*Primary Examiner*—John C Hong
(74) *Attorney, Agent, or Firm*—Buchanan Ingersoll & Rooney PC

(57) ABSTRACT

Side hole-bearing tubular bodies made of metal and having an inside diameter of up to 2 mm are manufactured by a method which includes punching from a metal sheet a sheet blank in the developed shape of a tubular body and punching in the sheet blank a hole which corresponds to the side hole in the tubular body and/or notches which form the side hole when the sheet blank is pressed into a tubular shape, in such a way that the metal sheet and the sheet blank remain partly joined; pressing the sheet blank into a tubular shape; and cutting apart the metal sheet and the sheet blank where they remain joined. Metal tubular bodies manufactured in this way can have one or more side holes of any shape, position or number thereon, and are highly suitable for use in medical devices such as syringe needles.

4 Claims, 3 Drawing Sheets

U.S. PATENT DOCUMENTS

| | | | |
|---|---|---|---|
| 4,945,635 | A | 8/1990 | Nobusue et al. |
| 4,997,423 | A | 3/1991 | Okuda et al. |
| 5,009,646 | A | 4/1991 | Sudo et al. |
| 5,217,668 | A | 6/1993 | Matsuzaki et al. |
| 5,477,604 | A | 12/1995 | Smith et al. |
| 5,776,268 | A | 7/1998 | McJames et al. |
| 5,941,899 | A | 8/1999 | Granger et al. |
| 5,968,076 | A | 10/1999 | Granger et al. |
| 6,165,402 | A | 12/2000 | Gabbard et al. |
| 6,626,404 | B2 | 9/2003 | Kleinikel et al. |
| 2003/0075588 | A1 | 4/2003 | Frohne et al. |
| 2003/0089414 | A1 | 5/2003 | Ooyauchi et al. |
| 2003/0127149 | A1 | 7/2003 | Ooyauchi et al. |
| 2003/0127494 | A1 | 7/2003 | Ooyauchi et al. |
| 2003/0211352 | A1 | 11/2003 | Ooyauchi et al. |

FOREIGN PATENT DOCUMENTS

| | | | |
|---|---|---|---|
| EP | 0 205 312 | A | 12/1986 |
| EP | 0 264 273 | B | 4/1988 |
| EP | 0 338 671 | B | 10/1989 |
| EP | 0 450 098 | A | 10/1991 |
| EP | 1308221 | A2 | 5/2003 |
| EP | 1323483 | A2 | 7/2003 |
| EP | 1323484 | A2 | 7/2003 |
| EP | 1361018 | A1 | 11/2003 |
| JP | 57-47637 | A | 3/1982 |
| JP | 2-065870 | A | 3/1990 |
| JP | 09-308910 | A | 12/1997 |
| JP | 2001-225106 | | 8/2001 |
| WO | WO 94/13345 | A | 6/1994 |
| WO | WO 99/38672 | A | 8/1999 |

METAL TUBULAR BODY AND MANUFACTURING METHOD THEREOF

This application is a divisional of U.S. application Ser. No. 10/329,513 filed on Dec. 27, 2002 now U.S. Pat. No. 6,877,652.

BACKGROUND OF THE INVENTION

1. Field of the Invention

The present invention relates to tubular bodies made of metal and to a manufacturing method thereof. More specifically, the invention relates to a method of manufacturing side hole-bearing tubular bodies made of metal and having a small inside diameter which can be used in such applications as pins, syringe needles and connectors, and to the tubular bodies thereby manufactured.

2. Prior Art

Metal tubular bodies of small diameter, e.g., a bore of up to 2 mm, used in various medical applications such as pins, syringe needles and connectors, are sometimes provided with one or more side holes, depending on the particular application. For example, JP 2-65870 A describes an indwelling needle having a side hole formed in an area other than the needle point to increase the drug solution infusing effect into a blood vessel. In such side hole-bearing indwelling needles, as illustrated by the process disclosed in this prior-art publication, the side hole is typically created by a punching operation after the needle being produced has been formed into a tubular shape. However, indwelling needles, particularly those of a small bore, in which a side hole has been formed by such a process undergo deformation of the side hole-bearing surface when locally subjected to pressure at the side hole-forming site. The flattened area that forms as a result increases resistance to needle penetration during a medical procedure and raises the level of pain experienced at the time of puncture. Moreover, it has been impossible in prior-art processes to form side holes anywhere other than on the bevel portion of the needle without deforming the tubular shape. This has limited the position, shape and number of side holes that can be formed on such needles. Also, in the manufacture of indwelling needles by a conventional process, because the tubular body, once formed, is placed on a die and a side hole is punched therein, another drawback has been an increased number of manufacturing steps.

SUMMARY OF THE INVENTION

It is therefore an object of the present invention to provide a method for manufacturing a metal tubular body in which one or more side holes have been formed in any desired shape, position or number. Another object of the invention is to provide a metal tubular body manufactured by this method.

Accordingly, the invention provides a method of manufacturing a side hole-bearing tubular body made of metal and having an inside diameter of up to 2 mm. The method includes the steps of punching from a metal sheet a sheet blank in the developed shape of a tubular body and punching in the sheet blank a hole which corresponds to the side hole in the tubular body and/or notches which form the side hole when the sheet blank is pressed into a tubular shape, in such a way that the metal sheet and the sheet blank remain partly joined; pressing the sheet blank into a tubular shape; and cutting apart the metal sheet and the sheet blank where they remain joined.

In the inventive method of manufacturing a metal tubular body, the sheet blank, after having been pressed into a tubular shape, is preferably welded at a seam thereon.

The invention additionally provides a metal tubular body manufactured by the foregoing method of the invention.

BRIEF DESCRIPTION OF THE DRAWINGS

In FIG. 1A, a sheet blank 2 in the developed shape of a tubular body has been punched from a metal sheet 1. In FIG. 1B, the sheet blank 2 has been pressed into a curved shape.

In FIG. 2C, the sheet blank 2 has been pressed into a U-shape. In FIG. 2D, the sheet blank 2 has been pressed into a tubular shape.

FIG. 3A shows a step corresponding to that depicted in FIG. 1A. FIG. 3B shows a step corresponding to that depicted in FIG. 2D.

FIG. 4A shows a step corresponding to that depicted in FIG. 1A. FIG. 4B shows a step corresponding to that depicted in FIG. 2D.

DETAILED DESCRIPTION OF THE INVENTION

Figure 1A:
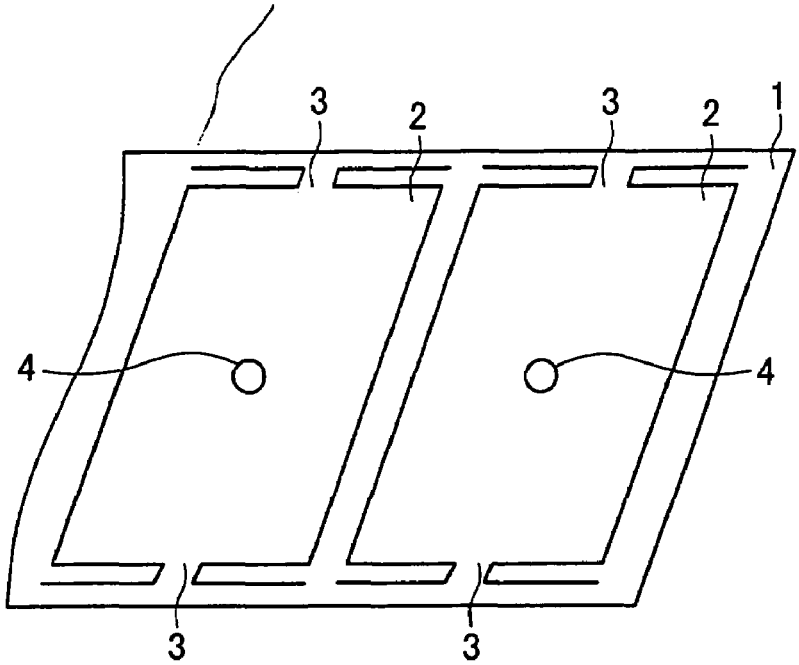
FIGS. 1A and 1B show steps in the manufacture of a tubular body according to one embodiment of the method of the invention.

The objects, features and advantages of the invention will become more apparent from the following detailed description of the metal tubular body and manufacturing method thereof to which the invention relates, taken in conjunction with the foregoing drawings.

The metal tubular body of the invention is a hollow tube which is open at both ends and provided with one or more side holes.

In the present invention, no particular limitation is imposed on the shape of side holes formed in the tubular body. Any desired shape may be suitably selected in accordance with the intended use, including shapes that may be broadly regarded as circular, such as perfectly circular and elliptical shapes; and shapes that may be broadly regarded as quadrangular, such as square and rectangular shapes.

Nor are the positions where side holes may be formed subject to any particular limitation. Such positions may be suitably selected as required, and a side hole may be formed even on the back side of the bevel at the tip of an indwelling needle, or at a position distal to the bevel on such a needle. For example, by forming a side hole on the back side of the bevel, when the tubular body is used as an indwelling needle and remains inserted for a long period of time, some blood flows out through the side hole, thus ensuring the flow of blood to the downstream side of the blood vessel and making it possible to lessen the degree to which normal blood flow through the blood vessel declines due to the presence of the needle. If a side hole is formed distal to the bevel on an indwelling needle, in cases where the needle is connected to a catheter or the like and used for introducing the catheter into the body, the leakage of blood from the side hole at the time of puncture makes it possible to visually confirm that the blood vessel has been accessed.

The number of side holes formed is not subject to any particular limitation, so long as there is at least one side hole. In addition, it is possible to form a plurality of side holes so that they face each other on the same circumference of the tubular body in an arrangement that may form a through-hole passing entirely through the walls of the tubular body.

In the invention, no particular limitation is imposed on the side wall shape of the tubular body. That is, the tubular body is not limited only to a straight shape of uniform diameter, but may instead have a stepped or tapered shape in which the diameter of the body varies from one position to another along the length thereof.

In the practice of the invention, the outside diameter of the tubular body is generally up to 5 mm, preferably up to 3 mm, more preferably up to 2 mm, and most preferably 1 mm or less. If the tubular body is to be used as a syringe needle, it has an outside diameter of preferably up to 2 mm, more preferably up to 1 mm, and most preferably 0.4 mm or less. When used as a syringe needle, a tubular body of the invention which has an outside diameter within the foregoing range provides less resistance to penetration and mitigates the pain experienced during an injection.

The tubular body of the invention has an inside diameter of up to 2 mm, preferably up to 1.5 mm, more preferably up to 0.8 mm, and most preferably 0.3 mm or less. A tubular body with an inside diameter within this range will have the requisite strength even when the outside diameter falls within the above-indicated range.

The tubular body of the invention should have a smooth inside wall. Specifically, it is advantageous for the inside wall of the tubular body to have a maximum difference between the highest and lowest smoothness values (Rf), as determined according to JIS B-0601 (1994), of 3 μm, preferably not more than 2 μm, and most preferably not more than 1 μm. A tubular body with an inside wall Rf within the foregoing range has an inside wall that is smooth throughout and free of large scratches, making the tubular body highly suitable for use as a medical device. A particular feature of the inventive tubular body is the fact that, in spite of having a side hole, the tubular body is free of deformation at the peripheral edge of the side hole on the inside wall. Hence, the entire inside wall is smooth.

The tubular body may be made of any suitable metal. For example, it may be made of a steel material such as stainless steel, a nonferrous metal structural material such as aluminum, copper or titanium, a heat-resistant material such as nickel, cobalt or molybdenum, a low-melting metal material such as lead or tin, a noble metal material such as gold, silver or platinum, or alloys of any of the above.

No particular limitation is imposed on the length of the tubular body. However, because a tubular body intended for use as a syringe needle is of necessity thin-walled, its length must be suitably selected in accordance with the strength required of the tubular body. For example, a tubular body which is to be used as a syringe needle and has a diameter corresponding to a syringe needle gauge of 25 to 33 must have a hardness of at least 200 Vickers.

The tubular body of the invention is manufactured from a metal sheet by pressing according to the method described below.

FIGS. 1A, 1B, 2C and 2D show an embodiment of the method of manufacturing metal tubular bodies according to the invention. The procedure depicted in these drawings illustrates one embodiment which is provided so that the inventive method can be more easily understood and is not to be construed as restrictive of the invention.

In the manufacturing method according to the invention, as shown in FIG. 1A, sheet blanks 2 in the developed shape of a tubular body are punched from a metal sheet 1 having a thickness of not more than 0.25 mm. Instead of punching the sheet blanks 2 from the metal sheet 1 in a cleanly cut state, the metal sheet 1 and the blanks 2 are left partly joined. As a result, in FIG. 1A, the center portions (sometimes referred to herein as "connections") 3 of the cutting lines on the short sides of the blanks 2 remain joined to the metal sheet 1. In the inventive method, holes 4 corresponding to the side holes of the tubular bodies being manufactured are punched in the sheet blanks 2. Punching may be carried out by a mechanical punching process or by a thermal process using a laser or other suitable means.

Figure 1B:
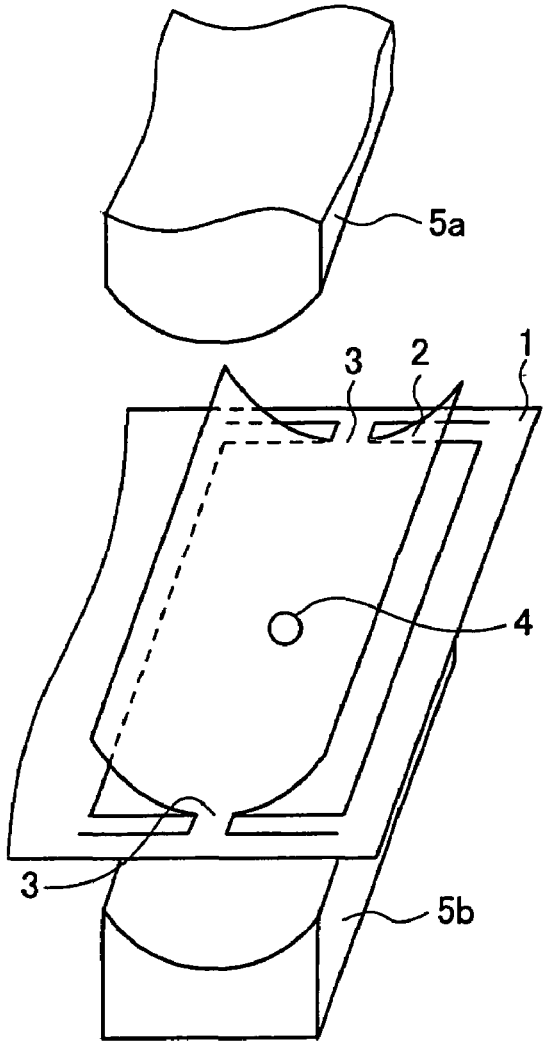
Figure 2C:
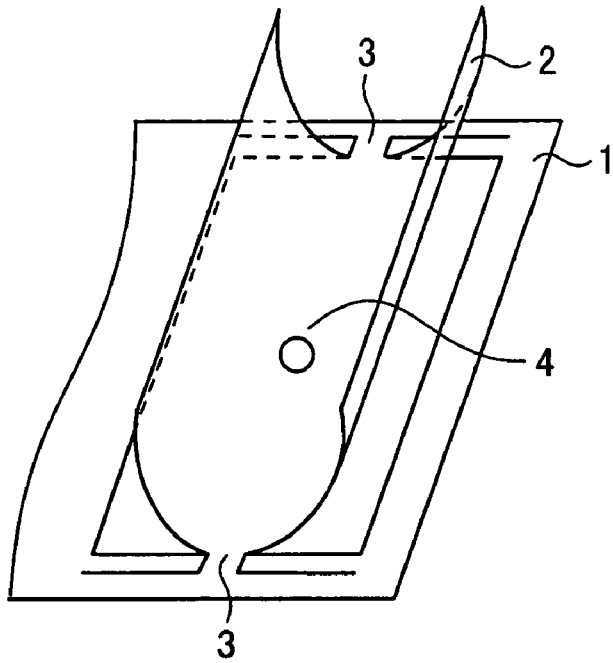
FIGS. 2C and 2D show additional steps in the manufacture of a tubular body according to the same embodiment of the method of the invention.
Figure 2C:
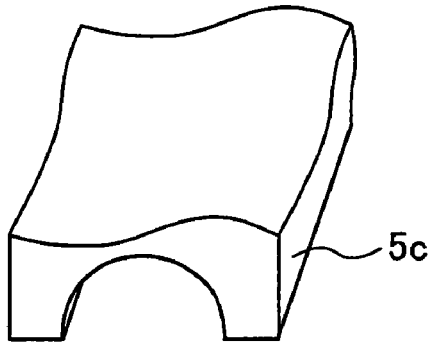
Figure 2D:
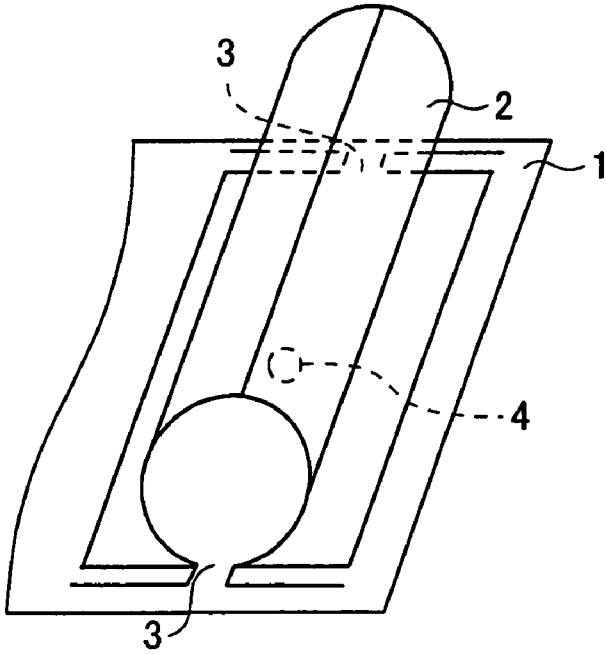

Referring to FIG. 1B, each sheet blank 2 is pressed from above and below using a pair of dies 5*a* and 5*b*. In FIG. 1B, by using an upper die 5*a* which is convex in combination with a lower die 5*b* which is concave, the sheet blank 2 is pressed into a curved shape about an axis defined by the connections 3 to the metal sheet 1. In FIG. 2C, which shows the sheet blank 2 after additional pressing, the sheet blank 2 is curved even further into a U-shape. Pressing of the sheet blank 2 into this latter shape may be achieved by continued pressing with the dies 5*a* and 5*b* shown in FIG. 1B, or by pressing with dies of other shapes. The sheet blank 2 that has been pressed into a U-shape is then pressed into a tubular shape using a concave upper die 5*c* in the manner shown in FIG. 2D. As will be readily apparent to one skilled in the art, pressing may be carried out in a number of additional stages using differently shaped dies until the sheet blank 2 has been pressed into a tubular shape like that shown in FIG. 2D.

As described above, in the inventive method, the hole 4 is formed in the sheet blank 2, following which the sheet blank 2 is formed into a tubular shape by pressing. Therefore, unlike prior-art cases in which the side hole is created after the sheet blank has been formed into a tubular shape, the vicinity of the side hole is not subjected to localized pressure. Hence, deformation of the tubular body does not arise.

No limitation is imposed on the order in which the hole 4 is formed and the sheet blank 2 is punched from the metal sheet 1. Formation of the hole 4 and punching of the sheet blank 2 from the metal sheet 1 may be carried out simultaneously or in any order. By carrying out formation of the hole 4 and punching of the sheet blank 2 from the metal sheet 1 at the same time, formation of the side hole in the tubular body does not result in an increased number of operations.

Moreover, because the hole 4 corresponding to the side hole is formed at the stage of the sheet blank 2, the shape, position and number of side holes 4 formed in the tubular body are not subject to any limitations.

It should also be noted that the hole or holes 4 formed in the sheet blank 2 are not limited to the position and shape shown in FIGS. 1A to 2D.

Figure 3A:
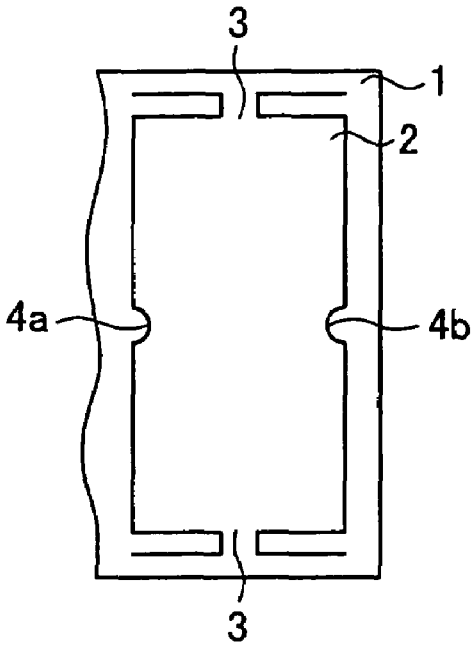
FIGS. 3A and 3B illustrate another embodiment of the method of the invention.
Figure 3B:
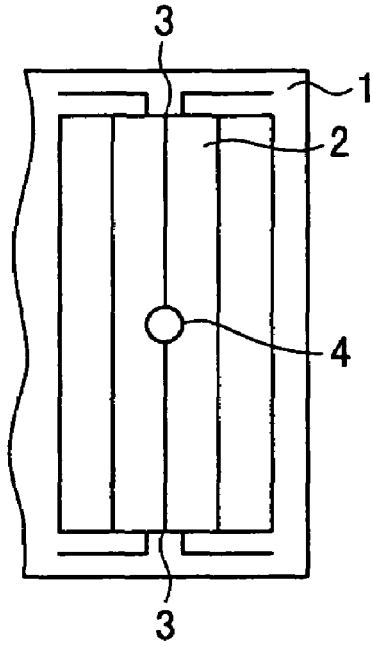

FIGS. 3A and 3B show another embodiment of the method of the invention. Here, unlike the embodiment shown in FIGS. 1A to 2D, in place of a hole, the sheet blank 2 has formed therein notches 4*a* and 4*b* which together form a side hole 4 when the sheet blank 2 is pressed into a tubular shape. In FIG. 3A, which shows a step corresponding to that shown in FIG. 1A, semicircular openings, or notches, 4*a* and 4*b* have been formed on both sides of the sheet blank 2. When a sheet blank 2 in which such semicircular notches 4*a* and 4*b* have been formed is pressed into a tubular body, the notches 4*a* and 4*b* meet as shown in FIG. 3B to form a side hole 4.

Figure 4A:
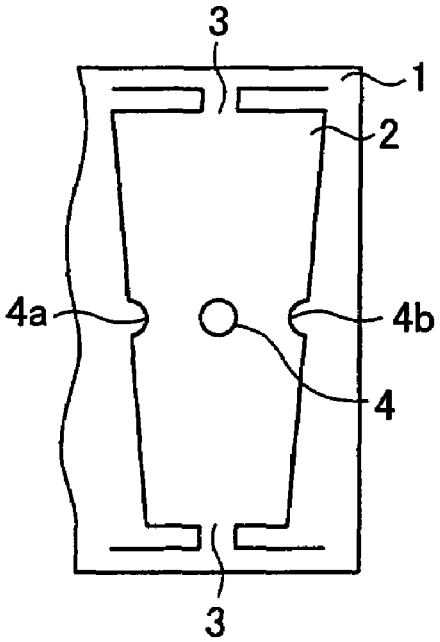
FIGS. 4A and 4B illustrate yet another embodiment of the method of the invention.
Figure 4B:
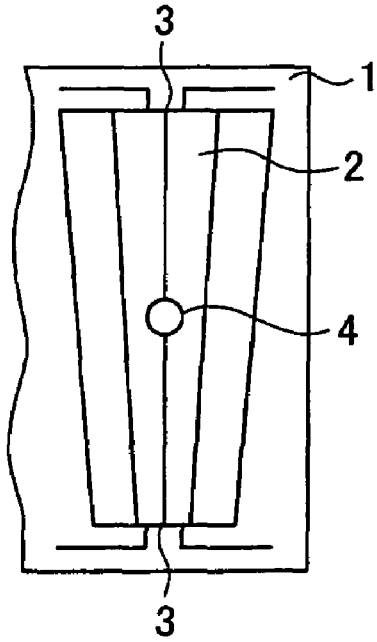

FIGS. 4A and 4B show yet another embodiment of the invention. In FIG. 4A, a trapezoidal sheet blank 2 has a circular hole 4 formed on an axis along which lie the connections 3 to the metal sheet 1, and also has semicircular notches 4*a* and 4*b* formed on either side of the sheet blank 2.

When such a sheet blank 2 is pressed into a tubular shape, as shown in FIG. 4B, there is formed a tubular body which has a tapered shape as seen from the side, one end being of smaller diameter than the other end, and which bears thereon two circular side holes 4 that are directly opposed to each other on the same circumference in an arrangement that may form a through-hole passing entirely through the walls of the tubular body.

In cases where a fluid will be passed through the lumen of the tubular body manufactured by pressing, such as when the tubular body is used as a syringe needle, the seam of the tubular body must be joined in a liquid-tight manner. Although the seam of the tubular body may be joined using an adhesive or other similar means, because the tubular body is made of metal and can have a very small outside diameter of 1 mm or less, the use of welding for this purpose is preferred. The welding process is preferably one which involves the melting of a base metal-containing joint to effect union. Preferred examples include laser welding techniques such as carbon dioxide laser welding, YAG laser welding and excimer laser welding. Of these, carbon dioxide laser welding and YAG laser welding are especially preferred because they are widely used, inexpensive and suitable for micromachining.

After the seam has been welded, the connections between the metal sheet and the sheet blank are cut, thereby giving the tubular body of the invention. In cases where welding is not carried out because the tubular body is intended for use in an application that does not require the seam to be joined in a particularly liquid-tight manner, the tubular body can be obtained by cutting the connections between the metal sheet and the sheet blank after the sheet blank has been pressed into a tubular shape.

Tubular bodies manufactured in this way can also be used after further processing in accordance with the intended application. For example, if the tubular body is to be used as a syringe needle, it will have to be subjected to additional machining such as the formation of a needle point thereon using a prior-art process.

EXAMPLE

The following example is provided to illustrate the invention, and is not intended to limit the scope thereof.

A 0.05 mm thick stainless steel (SUS304) sheet was subjected to pressing operations in the order shown in FIGS. 1A to 2D, thereby forming 1 mm outside diameter, 0.9 mm inside diameter, 20 mm long hollow tubes which are open at both ends. It was possible in this way to manufacture tubular bodies in which a 0.2 mm radius side hole of perfectly circular shape was formed at a position 3 mm from the distal end of the body.

The method of the invention enables the manufacture of a metal tubular body on which has been formed one or more desired side holes, regardless of shape, position or number thereof. The inventive method also makes it possible to manufacture at one time, and thus at low cost, a plurality of side hole-bearing, small-bore tubular bodies from a single, long metal sheet whose width is in the lengthwise direction of the tubular bodies. The metal tubular bodies manufactured by the method of the invention are obtained by punching holes corresponding to the side holes in sheet blanks prior to formation of the blanks into tubular shapes. As a result, unlike prior-art processes, pressure is not locally applied to the side hole-forming area after formation of the sheet blank into a tubular shape, and so the vicinity of the side hole on the tubular body is not flattened. Accordingly, side hole-bearing metal tubular bodies can be manufactured which, when used as syringe needles, do not exhibit increased resistance to penetration, and thus help minimize pain during puncture.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A metal tubular body having at least one side hole and an inside diameter of up to 2 mm, produced by the steps of:

punching from a metal sheet a sheet blank in the developed shape of a tubular body and punching in the sheet blank a hole which corresponds to the side hole in the tubular body or notches which form the side hole when the sheet blank is pressed into a tubular shape, or both, in such a way that the metal sheet and the sheet blank remain partly joined;

pressing the sheet blank into a tubular shape;

cutting apart the metal sheet and the sheet blank where they remain joined; and wherein the metal tubular body possesses an inner surface having a maximum height difference (Rf) in surface roughness of up to 3 μm.

2. The metal tubular body according to claim 1, wherein the sheet blank, after having been press formed into a tubular shape, is welded at a seam thereon.

3. A metal tubular needle having at least one side hole and an inside diameter of up to 2 mm, produced by:

punching, from a metal sheet, a sheet blank in a developed shape of a tubular body such that the metal sheet and the sheet blank remain partly joined;

punching a hole in the sheet blank which corresponds to the side hole in the tubular body and/or punching notches which form the side hole when the sheet blank is pressed into a tubular shape;

said punching of the hole and/or the notches occurring before, during or after said punching of the sheet blank from the metal sheet;

pressing the sheet blank, provided with said hole and/or said notches, to move opposite edges of the sheet blank towards one another and form a tubular shape sheet blank;

cutting apart the tubular shape sheet blank from the metal sheet where they remain joined;

machining the tubular shape sheet blank to form a needle point; and wherein the metal tubular needle possesses an inner surface having a maximum height difference (Rf) in surface roughness of up to 3 μm.

4. The metal tubular body according to claim 3, wherein the pressing of the sheet blank into the tubular shape produces a seam, and further comprising welding the tubular shape sheet blank at the seam.

* * * * *

UNITED STATES PATENT AND TRADEMARK OFFICE

CERTIFICATE OF CORRECTION

PATENT NO. : 7,587,820 B2
APPLICATION NO. : 11/062547
DATED : September 15, 2009
INVENTOR(S) : Ooyauchi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1183 days.

Signed and Sealed this
Third Day of May, 2011

David J. Kappos

David J. Kappos
*Director of the United States Patent and Trademark Office*